United States Patent [19]

Mimmack et al.

[11] Patent Number: 5,005,973

[45] Date of Patent: Apr. 9, 1991

[54] LASER BORESIGHTING METHOD AND APPARATUS FOR WEAPONRY

[75] Inventors: William E. Mimmack, El Paso, Tex.; William J. Thompson, El Cajon, Calif.

[73] Assignee: Cubic Corporation, San Diego, Calif.

[21] Appl. No.: 497,543

[22] Filed: Apr. 26, 1990

[51] Int. Cl.[5] ..... G01B 11/26; G02B 26/08

[52] U.S. Cl. ..... 356/152; 356/400; 350/486; 350/540; 350/574; 350/622

[58] Field of Search ..... 356/152, 399, 400; 350/486, 540, 544, 574, 577, 606, 618, 622, 623

[56] References Cited

U.S. PATENT DOCUMENTS

| | | | |
|---|---|---|---|
| 3,659,926 | 5/1972 | Charbonneau | 350/486 X |
| 4,097,155 | 6/1978 | Appert | 356/152 |
| 4,168,123 | 9/1979 | Price | 356/152 |
| 4,348,939 | 9/1982 | Hipp | 356/152 X |
| 4,386,848 | 6/1983 | Clendenin et al. | 356/5 |
| 4,614,913 | 9/1986 | Honeycutt et al. | 356/152 X |
| 4,618,224 | 10/1986 | Smith | 350/618 |
| 4,665,795 | 5/1987 | Carbonneau et al. | 356/152 X |
| 4,762,411 | 8/1988 | Pitalo et al. | 356/152 |
| 4,889,425 | 12/1989 | Edwards et al. | 356/152 |

*Primary Examiner*—Linda J. Wallace

*Attorney, Agent, or Firm*—Edward K. Kaprelian

[57] ABSTRACT

In a weapon boresighting system for aircraft and vehicles, an optical square is oriented to a fixed reference line on the vehicle and provides the directionality of a pair of orthogonally positioned of laser illuminated retroreflective catadioptric collimators attached to said optical square whose outputs are directed via one or more deviators or periscopes to a pair of retroreflective catadioptric receivers orthogonally attached to a second optical square positioned at the weapon to be boresighted, each said receiver imaging the laser on a position sensitive sensor, the outputs of the latter indicating the pitch roll and yaw condition at the weapon.

14 Claims, 4 Drawing Sheets

LASER BORESIGHTING METHOD AND APPARATUS FOR WEAPONRY

BACKGROUND OF THE INVENTION

1. FIELD OF THE INVENTION

This invention relates to a method and apparatus for boresighting such components as weapons systems and avionics equipment aboard fixed-wing and rotary-wing aircraft as well as tanks and other vehicles to thereby insure that a weapons delivery point coincides with its aimpoint. Through the use of optical metrology, the various components are boresighted to maintain alignment relative to the aircraft boresight reference line.

Specifically, this optical metrology system accomplishes boresighting through the transfer of a fixed reference line in yaw, pitch, and roll from a measurement reference line on an aircraft or other vehicle to various points including sighting stations, sensors and weapon stations.

For example, it is necessary that various modules on both rotary and fixed-wing aircraft maintain correct positions within 30 arc seconds or less. Through use of the boresighting system of the present invention, departures from the prescribed position can be measured and corresponding corrections effected.

Typical modules include a heading and attitude reference system, gun, stabilized sight unit, night vision unit, doppler radar, air data sensor, missiles, head-up display, forward looking infrared and laser spot tracker.

PRIOR ART

Alignment devices have been employed in the past to verify boresight alignment and to measure boresight error between a reference line of sight and the sighting means of the vehicle and a weapon on military aircraft and other vehicles.

One such system is that of U.S. Pat. No. 4,762,411 which shows a boresight alignment verification device comprising a portable cart spaced apart from the aircraft which carries the sights and weapons to be boresighted and employing a collimated light source and an extendable periscope which directs light to an optical reference fixture mounted at a line of sight on the aircraft. The reflected light is matched on a matrix camera against a beam-split portion of the projected light. This arrangement has the disadvantage of relative movement between the spaced-apart verification means during the frequently lengthy calibration period and corresponding repositioning, in contrast to applicant's system in which the verification means is attached to the aircraft and is not relatively movable thereto.

U.S. Pat. No. 4,191,471 shows an aircraft armament alignment arrangement employing a jig which is temporarily fastened to the aircraft. A collimated, incoherent light source is attached to the aircraft at a reference surface which defines an aircraft datum line. A collimator fastened to the jig carries a translucent screen with grid markings on which the image of the light source is visible. The jig is moved relative to the aircraft until the image is centered and is there fixed. Thus, the jig becomes an intermediate element for carrying directionality and alignment information to a weapon bore and to a sight. The collimated light source is next attached to produce a beam parallel to the bore of a gun pod and the gun pod adjusted so as to center its light beam on the screen of the repositioned collimator. The collimated light source is then moved to a socket on the jig and its light beam directed to an optical sight. The latter is then adjusted until its line of sight is parallel to the axis of the collimated light source. Factors detracting from the potential accuracy of this system are errors resulting from the use of an intermediate element and the repositioning of the light source and the collimator.

SUMMARY OF THE INVENTION

An object of this invention is to provide a means for boresighting a number of modules on an aircraft through employment of optical metrology principles.

This is accomplished, in its simpliest form, through use of a laser, a position sensitive sensor receiving light from said laser and one or more light deviating means positioned between the laser and the detector.

The apparatus consists of one or more optical cubes, a projector, a deviator section, and a sensor or receiver. The projector emits a collimated beam of laser light perpendicular to one mirrored face of the cube. The deviator is a form of periscope or retroreflector using mirrors or prisms for altering the direction or position of light while insuring that the displaced beam remains parallel to the incident beam. The sensor measures any difference in direction between an incoming beam (from the cube and the projector and via the deviator) and the direction perpendicular to a second optical cube. The projector is a retroflective catadioptric collimator shown here as a doublet, carrying on its axis a single mode optical fiber which terminates at the nodal point of the lens. The fiber directs light to the mirrored face of an optical cube, spaced a distance equal to one-half the focal length of the lens, which is then redirected to the lens. The fiber receives light from a solid state laser, which may have any convenient wavelength; for the present invention a wavelength of 670 nm is preferred.

The receiver is of a form similar to the projector, comprising a lens of doublet or other construction, and the mirrored face of an optical cube with a position sensitive detector or sensor located at the nodal point of the lens. The detector may be a lateral effect cell, a quadrant detector or a CCD camera.

The optical deviator may be of the zero deviation (rhomboid) or the 180 degree deviation type. In the former the reflectors are spaced-apart flat mirrors with their surfaces parallel. In the 180 degree deviation one flat mirror and one roof reflector or roof prism are used.

Deviators may be combined, or articulated, to provide a variable length between the point of light input and the point of light output. These cascaded or articulated deviators may be of either the zero deviator or 180 degree deviation type.

In use, the output of a projector is focused on the sensor in the receiver, with or without intervening deviators. Departure from an aligned condition results in an analog, digital or video representative which indicates the degree and direction of such departure.

DESCRIPTION OF THE PREFERRED EMBODIMENTS

Figure 1:
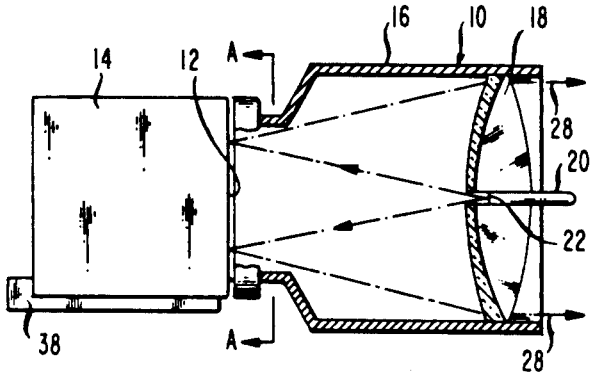
FIG. 1 shows, in cross-sectional view, an optical cube and projector for producing a collimated beam of laser light.
Figure 2:
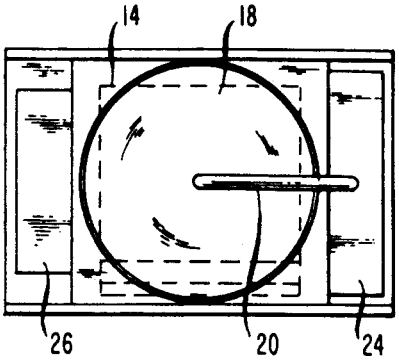
FIG. 2 shows the projector of FIG. 1 in front elevational view.

FIG. 1 shows in vertical cross section a typical transmitter 10 which cooperates with the mirrored face 12 of an optical cube 14. Transmitter 10 consists of a body 16 which carries within a cylindrical opening at one end a collimating lens 18, shown here as a doublet, which is provided with an axial hole. Into the hole is cemented or otherwise coaxially attached a single mode optical fiber 20 one end of which terminates at the second nodal point 22 of the lens. The other end of the fiber receives light from a laser diode 24 located in a cavity in the body as shown in FIG. 2. Electronics 26 for the laser are housed in a second cavity in the body. In case the very tight collimation provided by a single mode fiber illuminated by a laser is not needed (as with less extreme distances) a multi-mode communications fiber (core diameter on the order of 50 micrometers) illuminated with a non-coherent source (a light emitting diode for example) can be used.

Location of the end of the fiber at the nodal point insures that the direction of the projected beam remains perpendicular to the mirrored surface 12 despite any tilting of the transmitter. Embedding the light source for the collimator, i.e., the fiber, in the lens insures that the direction of the collimated light is not influenced by any movement of the transmitter whatsoever.

As best seen in FIG. 1, light emitted from the end of the fiber is reflected by mirrored surface 12 of cube 14 back to lens 18 from which it projects as a beam of collimated light 28.

Figure 3:
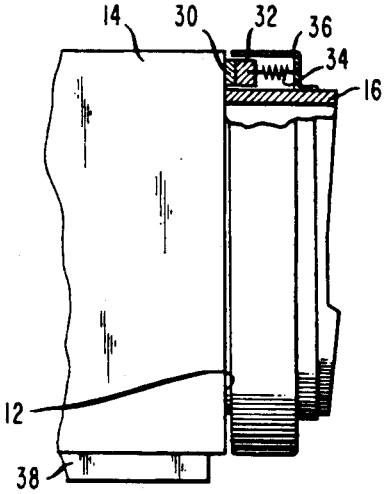
FIG. 3 shows, in detail the means for attaching the projector to the cube.
Figure 4:
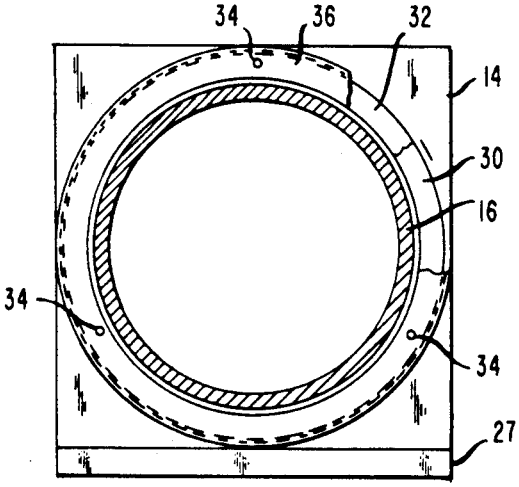
FIG. 4 shows the projector attached to the cube.

FIGS. 3 and 4 show a long view A—A of FIG. 1 and on an enlarged scale, one arrangement for attaching transmitter 10 to the optical cube. A flat steel washer 30 is cemented to a mirrored face of cube 10 and acts as one surface of a magnetic catch. An annular magnet 32 acting as the second face of the magnetic catch is carried on several extension springs 34 carried within an annular cover 36 fastened to body 16. When that end of body 16 is held against the cube, magnet 34 fastens itself to washer 30, and with the aid of springs 34 forces the end of body 16 into contact with the cube. Other arrangements using hooks, straps or clamps may be used as preferred.

Figure 5:
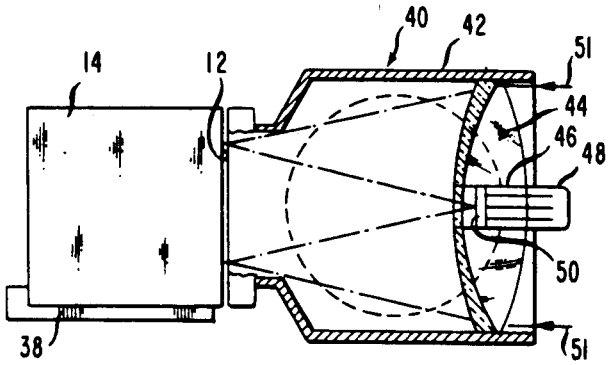
FIG. 5 shows, in partial cross-sectional view, an optical cube and a sensor for receiving light from a projector.
Figure 6:
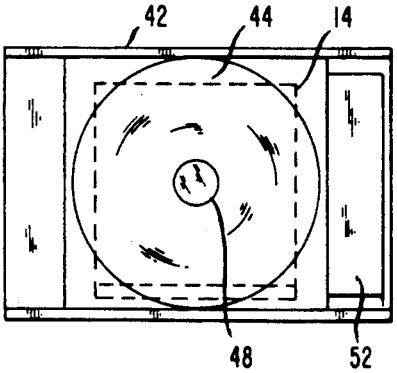
FIG. 6 shows the sensor of FIG. 5 attached to a cube.

FIGS. 5 and 6 show in partial sectional and front elevational views, respectively, a receiving sensor for cepting collimated light from the transmitter of FIGS. 1 to 4. The sensor housing, or receiver, 40, comprises a body member 42 which carries at one end a collimating lens 44 in an arrangement analagous to that of transmitter 10. Lens 44 is provided with an axial hole 46 into which is fitted, coaxially with lens 44, a position sensor 48, the active surface 50 of which is located at the nodal point of lens 44. Mirrored face 12 of optical cube 14, to which body 44 is fastened in a manner similar to that of FIGS. 1 to 4, cooperates with lens 44 to focus incoming collimated light 51 onto the surface of the position sensor. The position sensor may be a lateral effect cell, a quad cell, a charge coupled camera (CCD) or similar device. The electronics 52 for the position sensor are held on one side of the body. Location of the sensor at the nodal point of the lens insures the integrity of its optical axis in a manner similar to that of the fiber and lens arrangement of the transmitter.

Figure 7:
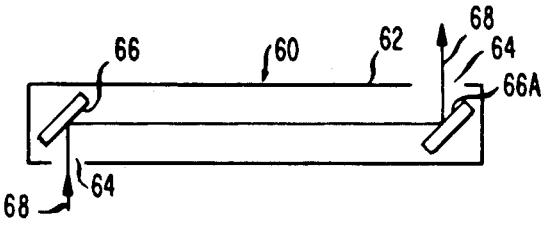
FIG. 7 shows, in partial cross-section, one type of deviator for delivering light from a projector to a sensor.

FIG. 7 shows, diagrammatically, a zero degree, or rhomboid, deviator 60 comprising a body 62 provided with entrance and exit windows 64 and 64A respectively and parallel flat reflectors 66 and 66A. The light path is delineated at 68.

Figure 8:
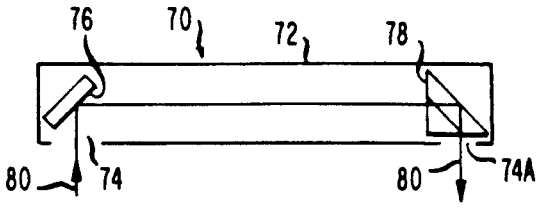
FIG. 8 shows, in partial cross section another type of deviator.

FIG. 8 shows, diagrammatically, a 180 degree deviator 70 comprising body 72, entrance and exit windows 74 and 74A respectively, a plane reflector 76 and a roof prism 78. The light path is shown at 80.

Figure 9:
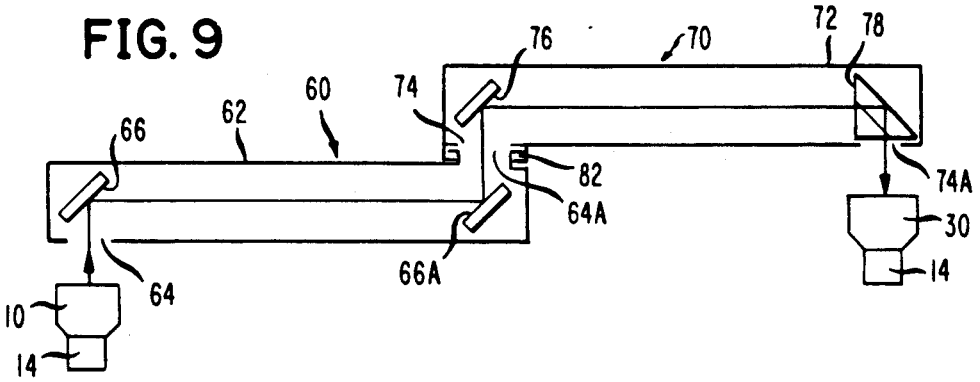
FIG. 9 shows a typical arrangement employing a projector, a sensor and two deviators.

A relatively simple boresighting arrangement using one zero degree deviator 60 and one 180 degree deviator 70 is shown in FIG. 9. Here, collimated light from projector 10 passes through window 64 of deviator 60, is reflected by mirrors 66 and 66A and exits through window 64A into window 74 of the 180 degree deviator 70, is reflected by mirror 76 and prism 78 and passes out of window 74A to a receiver 30. In the example shown here deviators 60 and 70 are joined at a hinge 82. If the image received at the position sensitive detector is not imaged at the latter's center, an electrical signal results indicating the direction and degree of departure from that center.

Figure 10:
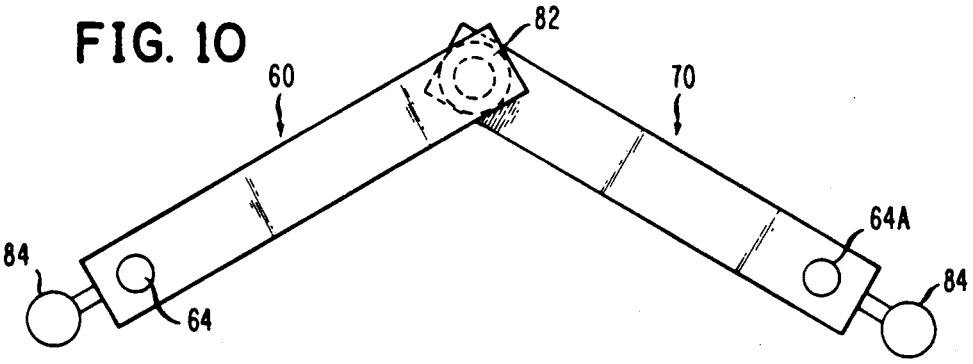
FIG. 10 shows a pair of deviators coupled together to form an articulated variable length structure.

FIG. 10 is a schematic showing of a pair of deviators similar to those of FIG. 7 in which the two deviators are swiveled at hinge joint 82 to have an angular relationship other than a straight line and to thereby allow flexibility in the extension distance. The deviators are provided with counterweights 84 to aid in holding their positions. Because of the high accuracy in mirror and prism position as well as that of the hinge, the integrity of a beam of collimated light from a projector entering window 64 is not lost or altered when it exits window 64A.

Figure 11:
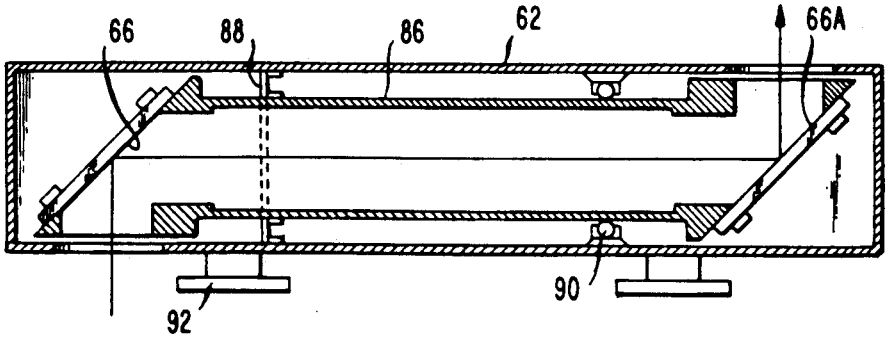
FIG. 11 shows the detailed structure of a zero degree deviator.

A somewhat more detailed showing of the zero degree deviator is shown in FIG. 11. Here, reflectors 66 and 66A are mounted at the ends of a rigid tube 86. Tube 86 is mounted at one end by means of a diaphragm 88 to outer body 62. At the other end it is supported by body 62 through a bearing 90. Diaphragm 88 and bearing 90 isolate the mirrors and their interrelationship from the effects of flexing of body 52, thereby insuring that the deviated beam is parallel to the incident beam. Suitable means such as feet 92 may be provided for supporting the deviator body on a convenient structure on the aircraft. When used to perform the full boresighting task on an aircraft, the system of the present invention uses a pair of the projectors of FIGS. 1 to 4 attached to adjacent faces of a primary reference cube.

The latter is itself previously accurately positioned with respect to the aircraft's boresight reference line and there held on an appropriate fixture. One projector can be arranged to measure pitch and yaw while the second can measure roll and yaw. If the optical path to the receivers is of moderate length, a pair of deviators are sufficient to bring the collimated light beam to the receivers. If the path length is so long as to require excessively long deviators whose integrity may be threatened because of uncompensatable bending, a transfer cube, described below, is used. The final receivers are attached to adjacent faces of a cube positioned at the boresight by means of a suitable fixture.

Figure 12:
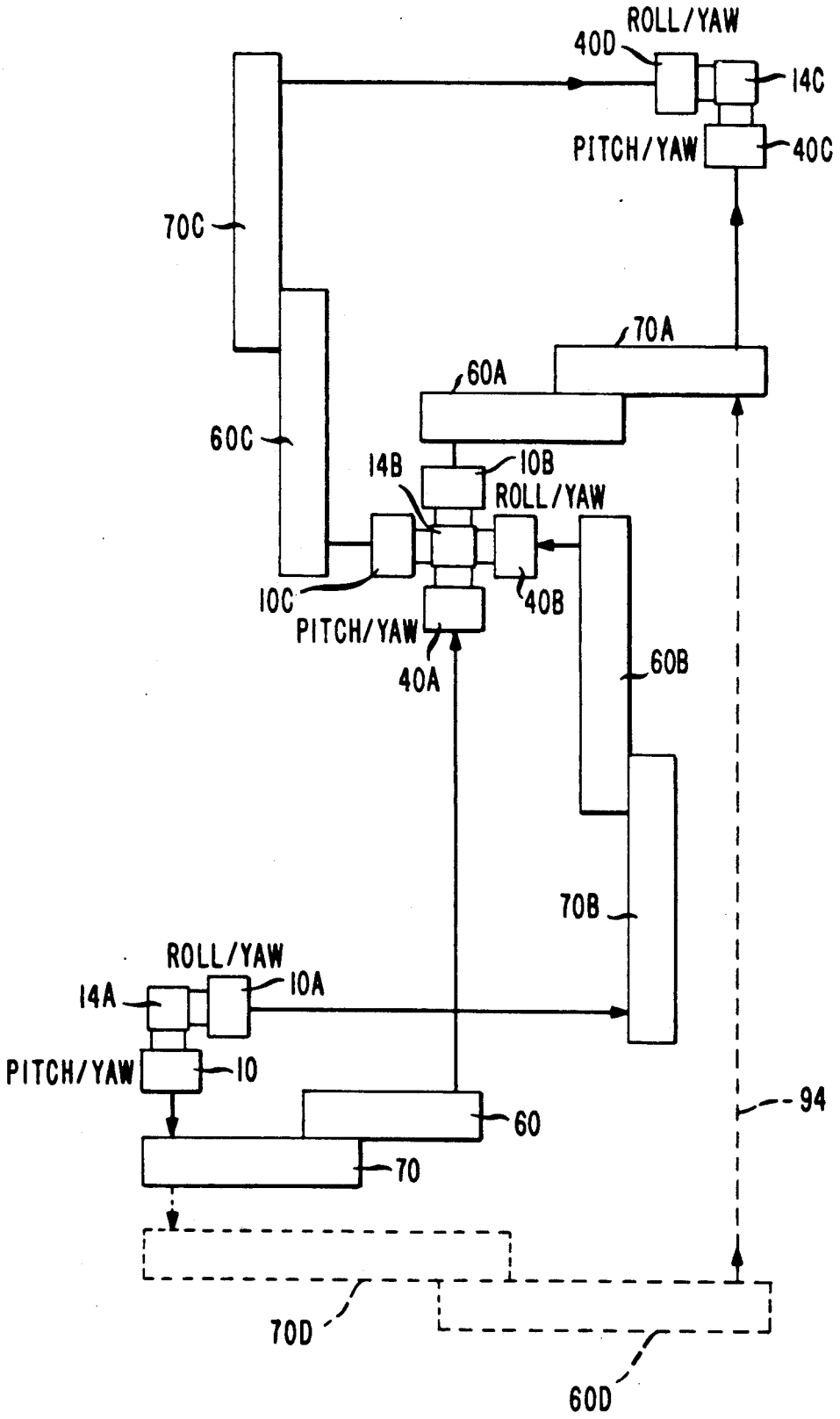
FIG. 12 shows the system set up to perform a full boresighting task.

FIG. 12 shows such an arrangement. A cube 14A, designated the primary reference cube, is locked in place at the boresight reference line. A pitch/yaw projector and a roll/yaw shown at 10 and 10A respectively are attached to cube 14 in the manner of FIGS. 1 to 6 or equivalent. Assuming that the path length is too great for a pair of deviators to span with convenience, an intermediate, or transfer cube 14B is held on pads fastened to any a convenient point on the aircraft structure or independently. Fixed on adjacent faces of cube 14B are a receiver 40A for pitch/yaw and a receiver 40B for roll/yaw. At the opposite faces on this cube are the corresponding pitch/yaw and roll/yaw projectors 10B and 10C respectively, which continue the collimated lines of sight.

At the boresighting station which may be a weapon, sight, forward looking infrared device or other apparatus, a third optical cube 14C is attached, carrying a pitch/yaw receiver 40C and a roll/yaw receiver 40. Pitch/yaw projector 10 is optically coupled to pitch/yaw receiver 40A through deviators 70 and 60. Secondary pitch/yaw projector 10B picks up the line of sight and through deviators 60A and 70A brings the collimated beam to pitch/yaw sensor 40C. Similarly, roll/yaw projector 10A sends its collimated beam via deviators 70B and 60B to receiver 40B. Secondary roll/yaw projector sends its collimated beam via deviators 60C and 70C to roll/yaw receiver 40D at the boresighting location. The signals from receivers 40C and 40D are processed to yield pitch, yaw and roll data.

It is also possible to obtain roll data by reference to gravity. In this modification, not shown, the transmitter and receiver each use a pendulum mirror in place of mirrored face 12. A transmitter-receiver pair is attached at the reference cube on the roll/yaw surface. A similar pair is attached at the station being boresighted. The difference is a measure of roll.

Obviously, if the line of sight between a projector at the primary reference cube is direct and relatively short, a transfer cube becomes unnecessary. Such a situation is illustrated in connection with pitch/yaw projector 10 where an alternate arrangement of deviators 70D and 70E can provide a direct path 94 to pitch/yaw detector 40C.

Figure 13:
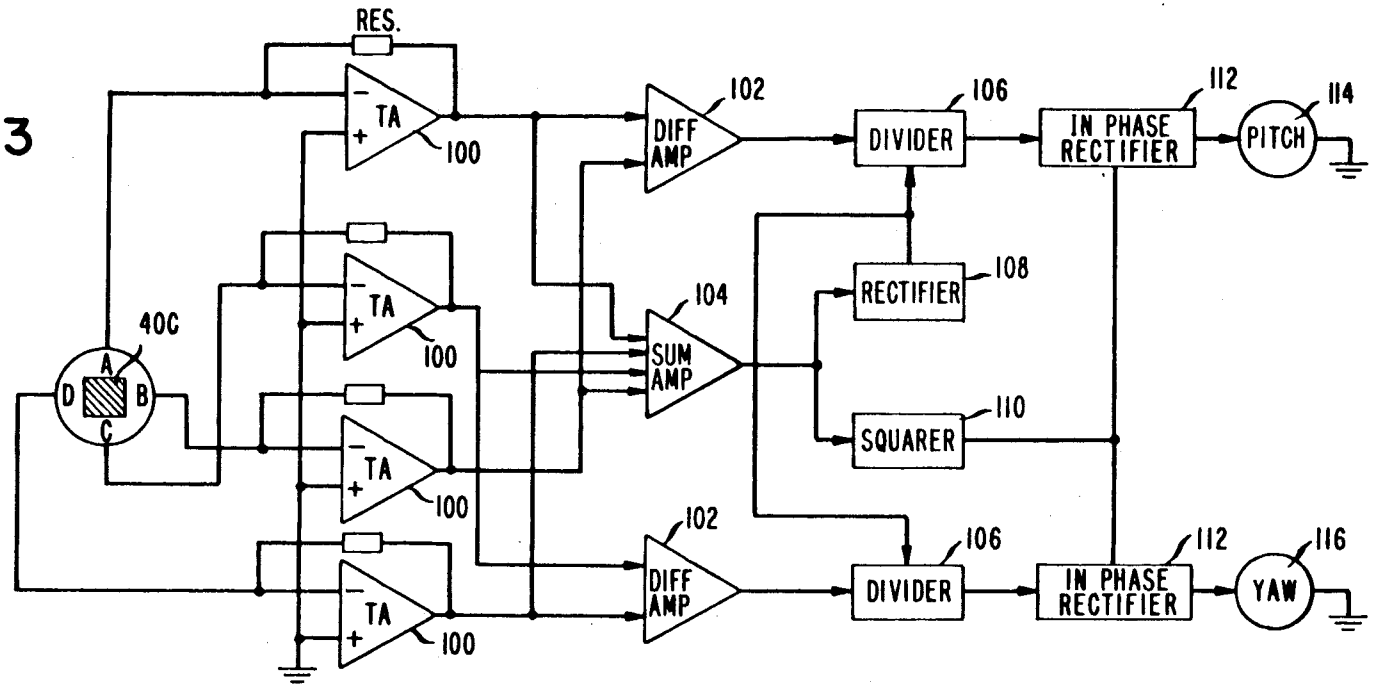
FIG. 13 is a block diagram for the pitch and yaw read-out unit.

FIG. 13 shows the block diagram for the pitch and yaw read-out unit. Here the output of the position sensor in receiver 40C is processed in turn by transimpedance amplifiers 100, differential amplifiers 102, summing amplifier 104, dividers 106, rectifier 108, squarer 110 and inphase rectifiers 112 to yield separate pitch and yaw data at displays 114 and 116 respectively.

Transimpedance amplifiers 100 convert the photocurrents from the position sensor into voltages which the differential amplifiers show as differences in the outputs of the position-sensitive sensor. The summing amplifier sums this output which is fed to the dividers which divide the resulting AC difference signal by the rectified sum signal to normalize the output. The AC sum signal is then squared by the squarer for a proper phase rectification of the displacement signal and the rectifiers develop a DC voltage which is proportional to the peak displacement signal amplitude.

Figure 14:
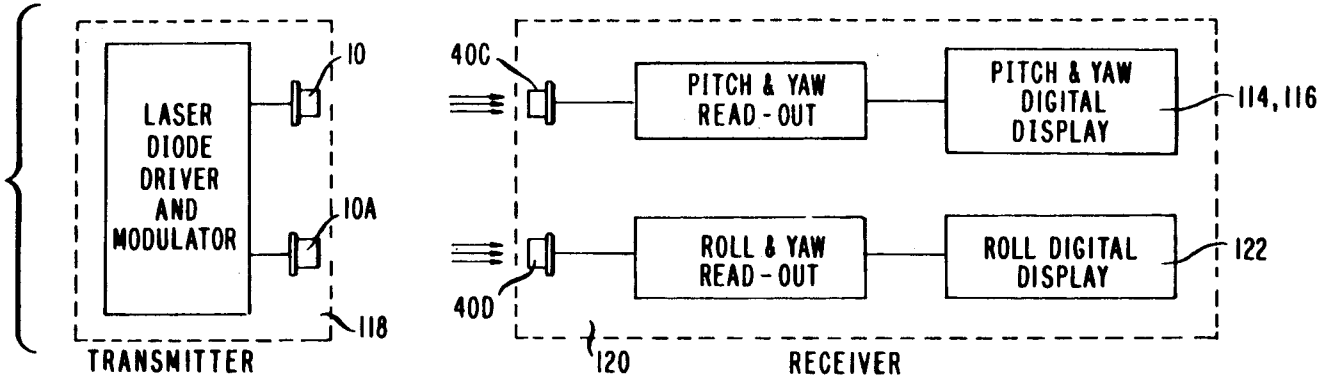
FIG. 14 is a block diagram showing the transmitter and receiver arrangement for display of pitch, yaw and roll.

FIG. 14 is a block diagram of the complete electronic system for the boresighting system comprising transmitter 118 and receiver 120. The former includes the laser driver and modulator for the lasers in projectors 10 and 10A of FIG. 12. The light beams from projectors 10 and 10A are received by the position sensitive sensors in receivers 40C and 40D for pitch/yaw and yaw/roll respectively. The top half of receiver 120 shows in simplified block form the block diagram of FIG. 13. The bottom half of receiver 118 is identical to FIG. 13, processing out the roll data to display 122 and discarding the already available yaw data.

We claim:

1. A boresighting system for establishing the boresight of a vehicle-borne weapon relative to a fixed reference line on said vehicle which establishes a first axis of reference, such system comprising a light source and a projector comprising a collimator lens receiving light from said light source to establish a second axis and positioned on the vehicle to project a collimated light beam parallel to said first axis of reference, a weapon positioned on said vehicle remotely from and in non-axial alignment with said projector, a position-sensitive sensor, a receiver positioned on said vehicle at said weapon and coaxial with said weapon for focusing the collimated light beam onto said position-sensitive sensor the output of which indicates departure from an alignment condition, and one or more optical deviators for directing the collimated light beam to the receiver.

2. The boresighting system of claim 1 wherein said collimator lens is of the retroreflective catadioptric type.

3. The boresighting system of claim 1 wherein the light source is a single mode optical fiber illuminated by a laser.

4. The boresighting system of claim 1 wherein the receiver is of the retrofocus catadioptric type.

5. A boresighting system for establishing the boresight of a vehicle-borne weapon relative to a fixed reference line on said vehicle comprising a first projector consisting of a first light source and a first retroreflective catadioptric collimator lens receiving light from said first source and positioned on the vehicle to project a first collimated light beam parallel to said fixed reference line, a first position-sensitive sensor, a first receiver positioned on said weapon for focusing the collimated light beam from said first projector onto said first position-sensitive sensor, one or more optical deviators for directing the collimated light beam from said first projector into said first receiver, a second light source and a second projector consisting of a retroreflective catadioptric collimator lens receiving light from said second light source and positioned on the vehicle orthogonally to said first projector to project a second collimated light beam at right angles to said first collimated light beam, a second position-sensitive sensor, a second receiver positioned on said weapon orthogonal to said first receiver for focusing the collimated light beam from said second projector onto said second position-sensitive sensor, said sensors producing signals for determining deviation in pitch, yaw and roll, and one or more optical deviators for directing collimated light from said second projector into said second receiver.

6. The boresighting system of claim 5 wherein said first and second projectors comprise an optical cube having mirrored surfaces on two adjacent faces, each cooperating with a collimator lens whose nodal point is positioned one-half its focal length from the corresponding mirrored surfaces.

7. The boresighting system of claim 6 wherein single mode optical fibers coaxial with each collimator lens face the corresponding mirrors, the emitting end of each optical fiber terminating at the nodal point of its lens.

8. The boresighting system of claim 7 wherein the other end of each optical fiber is illuminated by a laser.

9. The boresighting system of claim 8 wherein the sensitive surface of each of said position sensitive sensors is located at the nodal point of a corresponding lens.

10. The boresighting system of claim 8, wherein an electronic system comprising, in succession, transimpedance, differential and summing amplifiers, together with dividers, squarers, and rectifiers, through the respective steps of:

converting photocurrents to voltages;

delineating differences in the outputs of the position-sensitive sensor;

summing the output signals from the transimpedance amplifiers;

dividing the resulting AC difference signal by the rectified sum signal to normalize the output;

squaring the AC sum signal for a proper phase rectification of the displacement signal; and developing a DC voltage that is proportional to the peak displacement signal amplitude extracts from pitch-yaw and yaw-roll data, pitch, roll and yaw condition at the weapon.

11. The boresighting system of claim 5 wherein said first and second receivers comprise an optical cube having mirrored surfaces on two adjacent faces, each cooperating with a collector lens whose nodal point is positioned one-half its focal length from the corresponding mirrored surface.

12. The boresighting system of claim 5 wherein the light received at the first receiver measures pitch and yaw, and the light received at the second receiver from said second collimator measures yaw and roll.

13. The boresighting system of claim 5 wherein an optical deviator carrying a collimated light beam and its receiver terminate at one face of an optical transfer cube and a secondary projector on the opposite face together with a deviator transport a collimated light beam to the weapon boresight.

14. A method for boresight alignment of a vehicle-mounted weapon system to a vehicle-mounted sighting system comprising the steps of:

establishing on said vehicle a first collimated light beam parallel to an established reference line on the vehicle;

establishing on said vehicle a second collimated light beam orthogonal to said reference line;

projecting the first collimated light beam into one end of a first optical deviator comprising one or more periscopes;

projecting the second collimated light beam into one end of a second optical deviator comprising one or more periscopes; directing the first collimated light beam from the other end of said first optical deviator into a first receiver at the weapon system, said first receiver imaging the light beam onto a first position-sensitive sensor to provide pitch/yaw information and directing the second collimated light beam from the other end of said second optical deviator into a second receiver at the weapon system, said second receiver imaging the light beam onto a second position-sensitive sensor to provide roll/yaw information, and deriving from said pitch/yaw and yaw/roll information, the pitch, yaw and roll condition at the weapon system.

* * * * *